US008622247B2

(12) United States Patent
Zuloff

(10) Patent No.: US 8,622,247 B2
(45) Date of Patent: Jan. 7, 2014

(54) LIGHT UP LIQUID PROJECTION DEVICE AND METHOD THEREOF

(76) Inventor: Steve Zuloff, Chatsworth, CA (US)

( * ) Notice: Subject to any disclaimer, the term of this patent is extended or adjusted under 35 U.S.C. 154(b) by 152 days.

(21) Appl. No.: 13/181,904

(22) Filed: Jul. 13, 2011

(65) Prior Publication Data

US 2013/0015203 A1 Jan. 17, 2013

(51) Int. Cl.
*B65D 5/66* (2006.01)

(52) U.S. Cl.
USPC ..... 222/113; 222/1; 222/158; 222/192; 222/386; 362/101

(58) Field of Classification Search
USPC ..... 222/113, 79, 401, 400.8, 222/153.01–153.14, 192; 446/153, 176, 446/180; 604/220; 362/101, 96, 102, 112; 239/18
See application file for complete search history.

(56) References Cited

U.S. PATENT DOCUMENTS

| | | | | | |
|---|---|---|---|---|---|
| 1,394,456 | A | * | 10/1921 | Wanat | 446/192 |
| 2,477,984 | A | * | 8/1949 | Jackson | 222/78 |
| 2,547,450 | A | * | 4/1951 | Du Pont | 222/113 |
| 2,629,516 | A | * | 2/1953 | Badham | 222/79 |
| 4,239,129 | A | * | 12/1980 | Esposito | 222/79 |
| 4,597,527 | A | * | 7/1986 | Sands | 239/394 |
| 4,673,007 | A | * | 6/1987 | Huang | 141/95 |
| 4,733,799 | A | * | 3/1988 | Wiskur | 222/79 |
| 4,749,126 | A | * | 6/1988 | Kessener et al. | 239/12 |
| 4,901,922 | A | * | 2/1990 | Kessener et al. | 239/12 |
| 4,936,506 | A | * | 6/1990 | Ryan | 239/18 |
| 5,171,429 | A | * | 12/1992 | Yasuo | 210/94 |
| D351,007 | S | * | 9/1994 | Bednar et al. | D21/572 |
| 5,491,617 | A | * | 2/1996 | Currie | 362/96 |
| 5,662,406 | A | * | 9/1997 | Mattice et al. | 362/101 |
| 5,878,914 | A | * | 3/1999 | Johnson | 222/79 |
| 5,992,697 | A | * | 11/1999 | James | 222/175 |
| 6,039,460 | A | * | 3/2000 | Ng et al. | 362/267 |
| 6,076,741 | A | * | 6/2000 | Dandrel et al. | 239/18 |
| 6,254,247 | B1 | * | 7/2001 | Carson | 362/101 |
| 6,474,507 | B1 | * | 11/2002 | Hornsby et al. | 222/79 |
| 6,740,849 | B1 | * | 5/2004 | Cho | 219/200 |
| 7,281,642 | B2 | | 10/2007 | Orlowski | |
| 7,384,164 | B2 | * | 6/2008 | Yu | 362/101 |
| 7,571,837 | B2 | | 8/2009 | Orlowski | |
| 7,604,184 | B1 | * | 10/2009 | Chen | 239/289 |
| D621,452 | S | * | 8/2010 | Wong | D21/572 |
| 7,775,849 | B2 | | 8/2010 | Wong et al. | |
| 7,913,880 | B2 | * | 3/2011 | Chia | 222/386 |
| 8,459,819 | B2 | * | 6/2013 | Martindale et al. | 362/96 |
| 2003/0156950 | A1 | * | 8/2003 | Ostrowiecki | 417/234 |
| 2003/0178439 | A1 | * | 9/2003 | Hornsby et al. | 222/79 |

(Continued)

*Primary Examiner* — Paul R Durand
*Assistant Examiner* — Randall Gruby
(74) *Attorney, Agent, or Firm* — Howard C. Miskin, Esq.; Gloria Tsui-Yip, Esq.

(57) ABSTRACT

A light up projection device with a housing and an actuator. The housing has a cavity reservoir for storing a liquid, a front end with an aperture, and a rear end with an opening. The actuator has a handle portion and a plunger portion extending therefrom. The plunger portion encloses the opening of the rear end of the cavity reservoir and interacts with the cavity reservoir to vary the volume of the cavity reservoir. A light source disposed within the actuator illuminates the actuator, the cavity reservoir and/or the liquid being projected from the device. The light source is off when the handle portion abuts the housing. The light source is on when the handle portion is pulled away from the housing, such as when liquid is being drawn into the cavity reservoir or when liquid is being projected from the cavity reservoir through the aperture.

23 Claims, 3 Drawing Sheets

(56) References Cited

U.S. PATENT DOCUMENTS

2005/0056663 A1* 3/2005 Yu ..... 222/113
2005/0167445 A1* 8/2005 Mochiachvili et al. ..... 222/113
2006/0283882 A1* 12/2006 Escobar et al. ..... 222/113
2007/0012721 A1* 1/2007 Chuang et al. ..... 222/79
2008/0121652 A1* 5/2008 Orlowski et al. ..... 222/79
2009/0176439 A1* 7/2009 Chen ..... 446/153

* cited by examiner

LIGHT UP LIQUID PROJECTION DEVICE AND METHOD THEREOF

FIELD OF THE INVENTION

The present invention relates to a liquid projection device having a light up feature and the method thereof. In particular, a water gun that lights up when it is actuated.

BACKGROUND OF THE INVENTION

Water guns or squirters or projectors are common toys, especially for the summer. Children, and adults alike, enjoy getting splashed with water on a hot summer day. The water exiting or ejecting from such toys are typically safe and harmless because the stream of water is not very powerful.

A typical water gun has a reservoir to store a liquid, usually water, and a mechanism of projecting or ejecting the liquid from the reservoir out of a small opening of a water gun. The ejecting mechanism of most prior art water guns are manually powered: for examples, by the pumping action resulting from actuating a trigger, or the pushing of a plunger decreasing the volume of the reservoir.

Prior art water guns serve its basic purpose of ejecting water, but otherwise have limited entertaining values.

Therefore, there is a need for a liquid projection device that provides more entertainment with a light up feature, than just ejecting liquid.

SUMMARY OF THE INVENTION

The present invention provides a liquid projection device that lights up when it is actuated.

The liquid projection device of the present invention comprises a housing and an actuator. The housing receives and stores a liquid which is ejected upon manipulation of the actuator acting as a plunger. A light source is located in the actuator to light up the device, and the liquid exiting the device when the actuator is actuated.

BRIEF DESCRIPTION OF THE DRAWINGS

Preferred embodiments of the present invention have been chosen for purposes of illustration and description and are shown in the accompanying drawings forming a part of the specification wherein.

DETAILED DESCRIPTION OF THE PREFERRED EMBODIMENTS

Figure 1:
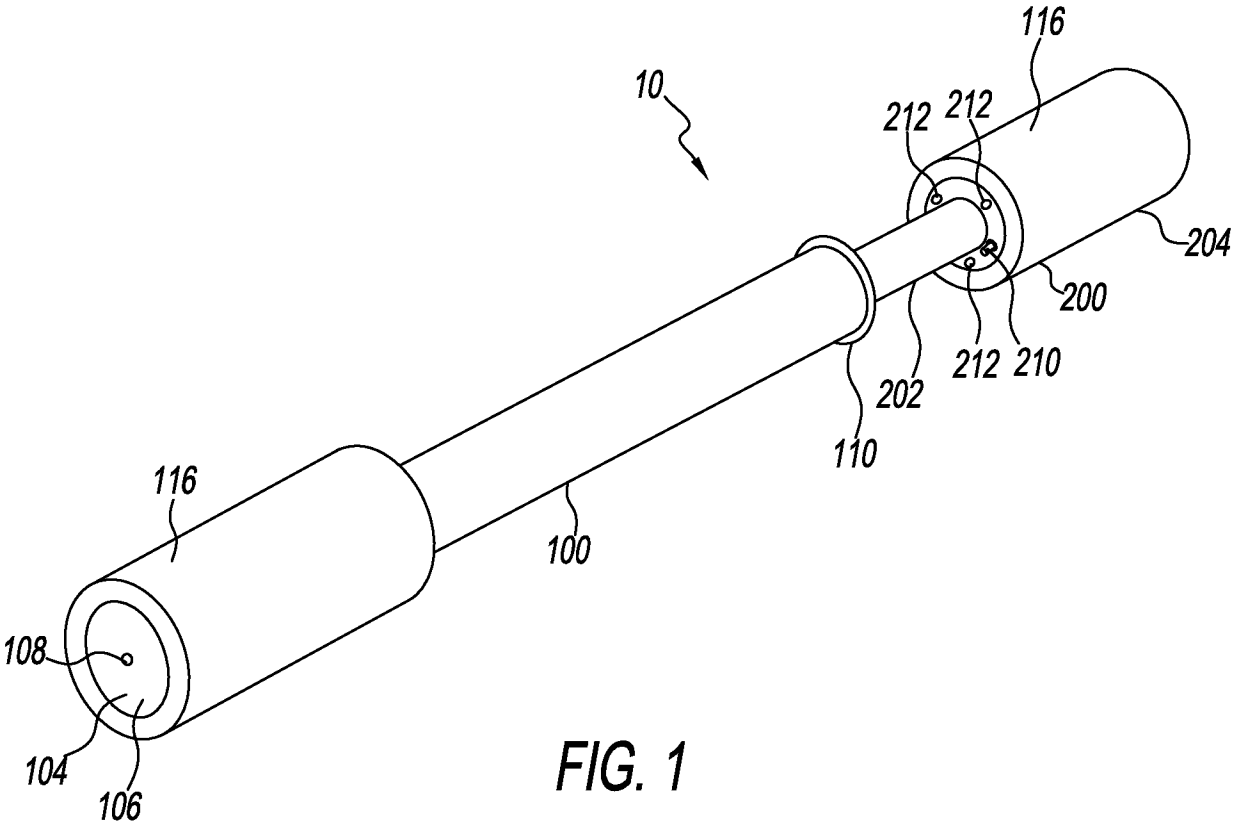
FIG. 1 is a perspective view of the light up liquid projection device of the present invention with the actuator in a partially expanded position.
Figure 2:
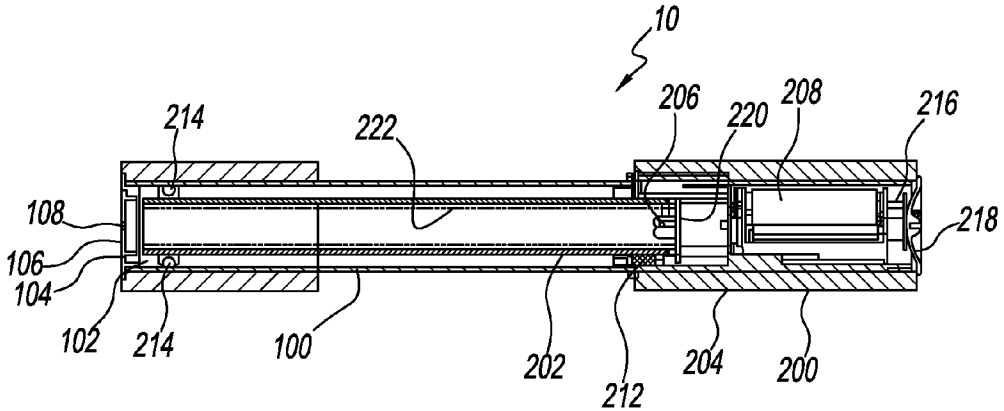
FIG. 2 is a cross sectional view of the light up liquid projection device with the actuator in the closed, contracted, position.

With reference to the drawings, wherein the same reference number indicates the same element throughout, there is shown in FIGS. 1-4 a liquid projection device 10 of the present invention comprises an elongated housing 100 and an actuator 200. The actuator 200 has a plunger portion 202 and a handle portion 204. The housing 100 has an axial cavity reservoir 102 for storing a liquid 20 (not shown). The front end 104 of the housing 100 has a transparent/translucent cover 106 with a small aperture 108 that serves as both the inlet and outlet for the liquid 20 in the cavity reservoir 102. At the rear end 110 of the housing 100 is an opening 112 that receives the plunger portion 202 of the actuator 200, which encloses the other end of the cavity reservoir 102.

The plunger portion 202 of the actuator 200 is sized to correspond and be slightly smaller than the internal dimension of the cavity reservoir 102. Near the distal end of the plunger portion 202 is a sealing ring 214 that interacts with the wall of the cavity reservoir 102 to enclose the other end of the cavity reservoir 102. The axial movement of the actuator 200 interacts with wall of the cavity reservoir 102 of housing 100 to increase and decrease the volume of the cavity reservoir 102 (see FIGS. 2 and 3). The axial length of the plunger portion 202 is substantially the same as the axial length of the cavity reservoir 102 (see FIG. 2).

Within the handle portion 204 adjacent the plunger portion 202 is one or more light emitting diodes ("LED") 206 that are powered by a power source, such as batteries 208, located in the handle portion 204. Alternatively, the LEDs 206 may be positioned along the length of the plunger portion 202. The plunger portion 202 is preferably hollow to allow the lights emitted from the LEDs 206 be projected along the entire axial length of the plunger portion 202. Further, a reflection film 222 may be provided within the axial length of the plunger portion 202 to further project the lights emitted from the LEDs 206. The plunger portion 202 and the housing 100 are made of either a transparent or translucent material so that light emitted from the LEDs 206 can be seen through them. The outer surface of the housing 100, except the ends, may be covered, partially or in its entirety, with a transparent or translucent soft material such as polyethylene foam 116 that provides cushioning while allowing the light from the LEDs 206 to be seen through. The outer surface of the handle portion 204 may similarly be covered, partially or in its entirety, with polyethylene foam 116.

Figure 3:
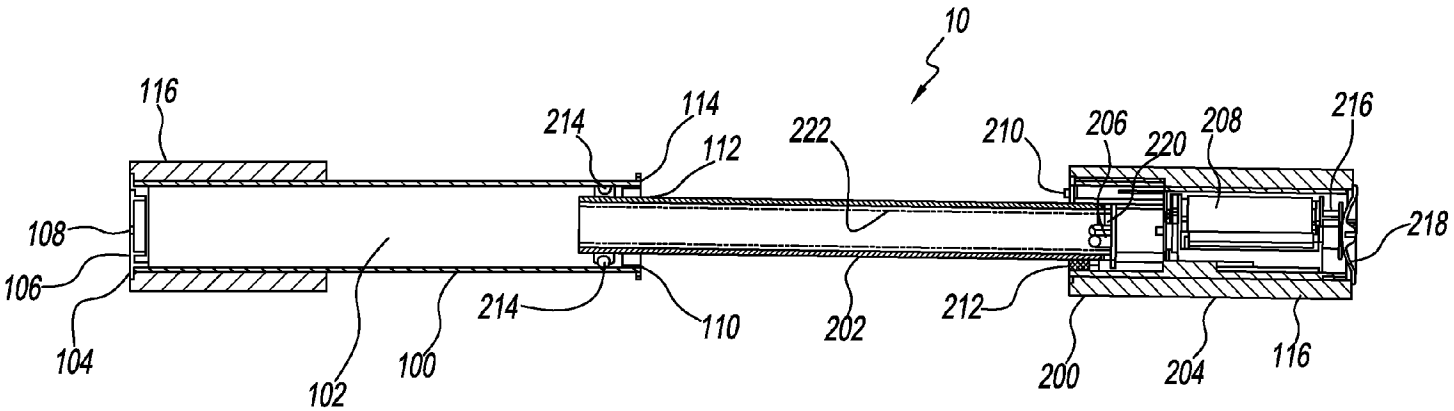
FIG. 3 is a cross section view of the light up liquid projection device with the actuator in the fully expanded position.
Figure 4:
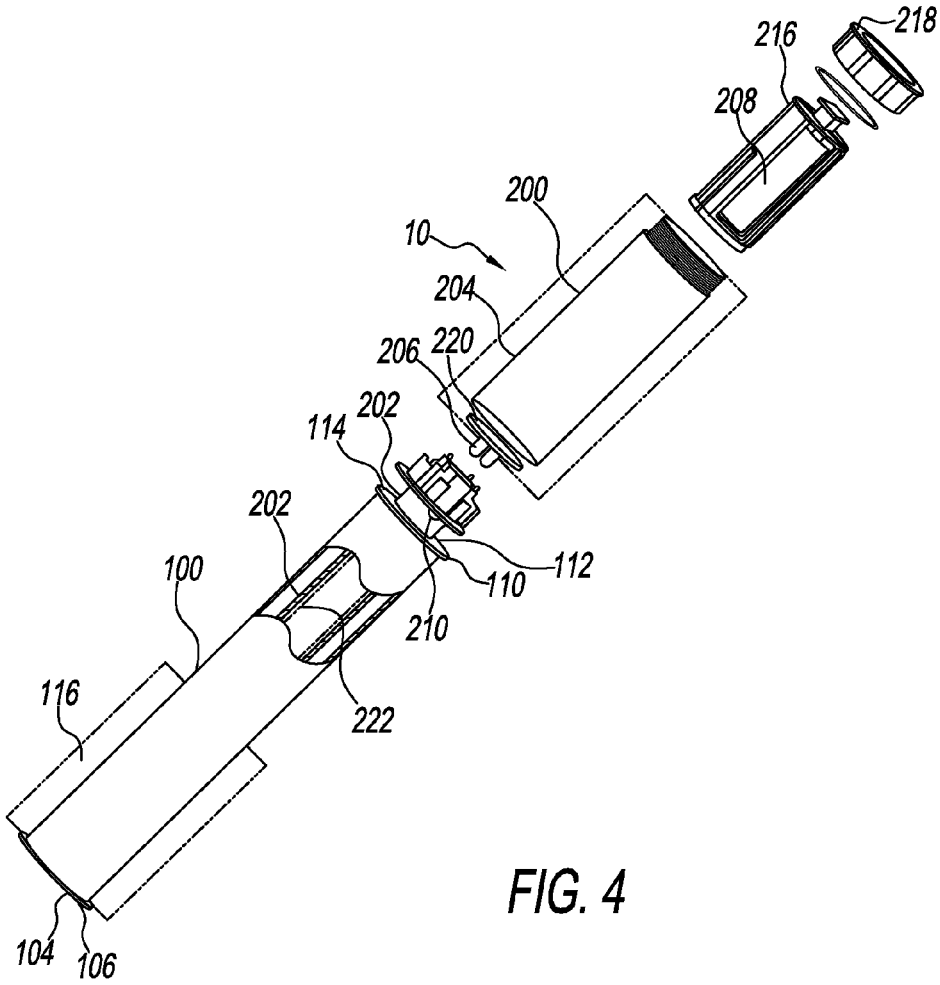
FIG. 4 is an exploded view showing the actuator of the light up liquid projection device of the present invention.

The on-off switch 210 for the LEDs 206 is a pressure switch located on the handle portion 204 facing the rear end 110 of the housing 100 such that when the device 10 is in a closed, contracted position, the power is off (see FIG. 2) and when the device 10 is in an expanded position, the power is on (see FIG. 3). Adjacent the on-off switch 210 is one or more magnets 212 with a corresponding magnetizable material 114 (such as a stainless steel plate) at the rear end 110 of the housing 100 to provide positive attraction between the handle portion 204 and the housing 100. This minimizes the chance of inadvertently leaving the on/off switch 210 in the on position due to the device 10 not being in the fully closed, contracted, position, and thereby draining the batteries 208.

To fill liquid in the cavity reservoir 102 through the aperture 108, with the aperture 108 immersed in the liquid, the handle portion 204 of the actuator 200 is pulled away from the housing 100, drawing the liquid into the cavity reservoir 102. Upon separating the handle portion 204 from the housing 100, the LEDs 206 are switched on, lighting the plunger portion 202 and the cavity reservoir 102. To eject liquid from the housing 100 through the aperture 108, the handle portion 204 is pushed towards the housing 100, with the LEDs 206 lighting the stream of liquid exiting the aperture 108. Once the handle portion 204 is again abutting the housing 100, and no more liquid exits the aperture 108, the LEDs 206 are switched off.

The batteries 208 for the LEDs 206 may be located at the handle portion 204, within a battery compartment 216 having a water-tight, re-sealable, cap 218. Other alternate power source known to one skilled in the art may be used. For example, rechargeable batteries may be charged by the pumping action of the actuator 200.

A multi-color RGB (red, green, blue) LED 206 or three single color (red, green, and blue) LEDs 206 can be used with the liquid projection device 10 to produce many different colors and effect. The LEDs 206 may be connected to and controlled by a printed circuit board 220 having pre-programmed lighting sequence.

The housing 100, the handle portion 204 and the polyethylene foam 116 are shown in FIGS. 1-4 to be generally cylindrical. However, they can be of any other ornamental shape or configuration without affecting or detracting from the concept of the present invention.

The liquid projection device 10 may also contain a sound chip with audio files and at least one waterproof speaker. The sound chip may be actuated similarly with the on/off switch 210 for the LEDs 206 and connected to and controlled by the printed circuit board 220.

In another alternative embodiment of the liquid projection device 10, the LEDs 206 may be ultra-violet LEDs that produce black light. A user may use liquid having fluorescent or phosphorescent paint or pigment with such a liquid projection device 10 to produce a glowing stream of liquid exiting the device 10.

The features of the invention illustrated and described herein are the preferred embodiments. Therefore, it is understood that the appended claims are intended to cover the variations disclosed and unforeseeable embodiments with insubstantial differences that are within the spirit of the claims.

What I claim is:

1. A device for projecting a liquid, comprising:

a. a housing having a cavity reservoir for storing the liquid, a front end with an aperture for receiving the liquid and allowing the liquid to exit, and a rear end with an opening;

b. an actuator enclosing said opening of said rear end of said cavity reservoir and interacting with said cavity reservoir to vary the volume of said cavity reservoir in order to receive liquid into or project liquid from said cavity reservoir; and c. a light source disposed within said actuator directed at said aperture illuminating said actuator, said cavity reservoir and the liquid being projected from said aperture of the device.

2. The device of claim 1 wherein said actuator comprises a handle portion and a plunger portion extending therefrom, said plunger portion enclosing said opening of said rear end of said cavity reservoir and interacting with said cavity reservoir to vary the volume of said cavity reservoir, and said light source is in said handle portion.

3. The device of claim 2 wherein said actuator further having a sealing ring near the distal end of said plunger portion that interacts with said cavity reservoir to enclose said opening and to vary the volume of said cavity reservoir.

4. The device of claim 2 wherein said plunger portion is hollow.

5. The device of claim 2 wherein said plunger portion and said housing are made of a transparent material.

6. The device of claim 2 wherein said plunger portion and said housing are made of a translucent material.

7. The device of claim 2 further comprising an on/off switch for said light source, wherein said switch is in the off position when the device is in the closed, contracted, position with said handle portion abutting said housing portion, and said switch is in the on position when the device is in an open, expanded position with said handle portion not abutting said housing portion.

8. The device of claim 7 wherein said handle portion having at least one magnet and said housing having a corresponding magnetizable material to provide a positive attraction of said handle portion to said housing.

9. The device of claim 7 wherein said housing having at least one magnet and said handle portion having a corresponding magnetizable material to provide a positive attraction of said handle portion to said housing.

10. The device of claim 1 wherein said front end of said housing is made of a transparent material.

11. The device of claim 1 wherein said front end of said housing is made of a translucent material.

12. The device of claim 1 wherein said light source comprises one or more light emitting diodes.

13. The device of claim 1 wherein said light source is a multi-color light emitting diode.

14. The device of claim 1 wherein said light source is a ultra-violet light emitted diode.

15. The device of claim 1 further comprising a power source for said light source disposed within said actuator.

16. The device of claim 15 wherein said power source comprises at least one battery.

17. The device of claim 1 wherein a portion of each of said housing and said actuator is covered by a transparent soft material.

18. The device of claim 1 wherein a portion of each of said housing and said actuator is covered by a translucent soft material.

19. The device of claim 1 further comprising an audio source disposed within said actuator, wherein said audio source comprises a sound chip and at least one speaker.

20. A method of lighting up a device and a stream of liquid projected from the device, comprising the steps of:

a. providing a housing having a cavity reservoir for storing the liquid, a front end with an aperture for receiving the liquid and allowing the liquid to exit, and a rear end with an opening;

b. providing an actuator having a handle portion and plunger portion extending therefrom, said plunger portion enclosing said opening of said rear end of said cavity reservoir and interacting with said cavity reservoir to vary the volume of said cavity reservoir in order to receive liquid into or project liquid from said cavity reservoir;

c. providing a light source disposed within said handle portion directed at said aperture illuminating said plunger portion, said cavity reservoir and the liquid being projected from said aperture of the device;

d. providing an on/off switch for said light source;

e. actuating said actuator to receive said liquid through said aperture and to switch said light source to the on position by pulling said handle portion away from said housing with said light source illuminating said plunger portion and said cavity reservoir; and f. actuating said actuator to project a stream of said liquid from said aperture by pushing said handle portion towards said housing while said light source illuminating said plunger portion, said cavity reservoir and the stream of the liquid being projected from said aperture.

21. The method of claim 20 further comprising the step of:

g. switching said light source to the off position by pushing said handle portion towards said housing such that said handle portion abuts said housing.

22. The method of claim 21 wherein said handle portion having at least one magnet and said housing having a corresponding magnetizable material to provide a positive attraction of said handle portion to said housing.

23. The method of claim 21 wherein said housing having at least one magnet and said handle portion having a corresponding magnetizable material to provide a positive attraction of said handle portion to said housing.

* * * * *